US005512104A

United States Patent [19]

Mizushiri et al.

[11] Patent Number: 5,512,104

[45] Date of Patent: Apr. 30, 1996

[54] METHOD TO SEPARATE AND RECOVER RESIN AND STEEL PIPE FROM RESIN-COATED STEEL PIPE

[75] Inventors: Toshitsugu Mizushiri; Mamoru Yokota; Norimichi Nakamura; Ken Ota; Shuji Yoshino; Noboru Inoue, all of Shizuoka, Japan

[73] Assignee: Yazaki Industrial Chemical Co., Ltd., Shizuoka, Japan

[21] Appl. No.: 212,597

[22] Filed: Mar. 11, 1994

[51] Int. Cl.[6] ..... B08B 1/00; B08B 3/12; B08B 7/02

[52] U.S. Cl. ..... 134/1; 134/5; 134/10; 134/19; 134/32; 134/16; 134/17

[58] Field of Search ..... 134/1, 5, 19, 10, 134/16, 17, 32, 38; 427/156, 358, 409, 544

[56] References Cited

U.S. PATENT DOCUMENTS 3,236,688 2/1966 Kahn ..... 134/5
3,923,653 12/1975 Lavins, Jr. ..... 134/5
3,941,087 3/1976 Yazaki ..... 118/306
4,534,801 8/1985 Matsuoka et al. ..... 134/17

FOREIGN PATENT DOCUMENTS 2063689 3/1987 Japan ..... 134/19

*Primary Examiner*—Zeinab El-Arini
*Attorney, Agent, or Firm*—Smith-Hill and Bedell

[57] ABSTRACT

In order to utilize separately steel pipe and coating resin as recycling resources, resin-coated steel pipe, which is produced by adhering a thermo-plastic coating resin on the surface of steel pipe with an adhesive, is heated by high-frequency induction heating to at least the melting temperature of the coating resin, and the coating resin is scraped off while the inner layer thereof is in a melted condition and the outer layer is in a softened condition. Coating resin and steel pipe can be recovered without the composition thereof being damaged. The scraping of coating resin is complete and efficient and requires only minimal energy since it occurs when the inner layer of the coating resin is in a melted condition and the outer layer is in a softened condition.

16 Claims, 4 Drawing Sheets

METHOD TO SEPARATE AND RECOVER RESIN AND STEEL PIPE FROM RESIN-COATED STEEL PIPE

BACKGROUND OF THE INVENTION

The present invention relates to the recycling of resin-coated steel pipes collected as waste, whether actually previously used or not, and, in particular, relates to a method for separating steel pipe from its resin coating for effective recycling of such material.

The object of the invention is to provide an effective method of easily separating steel pipe from its resin coating in such a manner that the separated resin is scraped off into chips or long strips convenient for recycling and, containing no moisture or other foreign matter, can be used in an ensuing recycling process without any preprocessing, and which is suited for large-scale industrialized processing.

Resin-coated steel pipe 4, as shown in FIG. 1, which consists of steel pipe having a thickness of 0.8 mm and an outer diameter of 26–40 mm and a coating 10 of thermoplastic synthetic resin such as AAS acrylonitrile acryl styrene or ABS acrylonitrile butadiene styrene, having a uniform thickness of about 1 mm fixed on the steel surface with an adhesive applied there as a thin film, is rust-free, comfortable to the touch, colorful and is mechanical strong. It is widely utilized as a frame member for shelves and trolleys that are exposed to sea water in marine-related industries; as a frame member for chairs, tables, beds and stands in ordinary households; or as a frame member for benches, flowerpot stands and wisteria trellises outdoors.

The processes and equipment for manufacturing such resin-coated steel pipes are disclosed, for example, in the specifications and drawings of Japanese Patent publication S57-2498 or U.S. Pat. No. 3,941,087, and are well known.

Resin-coated steel pipes used as frame members for the various products mentioned above become, in due course, industrial waste as the products are, for some reason, no longer used or are simply discarded after losing durability. The scraps or pieces generated when pipes are cut for the construction of the various products mentioned above also become industrial waste if no use can be found for them.

The conventional method of disposing of resin-coated steel pipe waste consists of nothing better than cutting the pipes to pieces of about 15 cm in length, flattening them with a press to reduce their volume and burying them in reclaimed land, because heretofore it has been very difficult to separate the resin coating from the pipe surface due to the firm adhesion between them. This is a very easy method of disposal; however, this method precludes the recycling of otherwise useful resource, and only increases the volume of disposed waste, requiring additional land for burial.

When it has become necessary to dispose of a small quantity of waste resin-coated steel pipes, it has also been a practice to cut the pipes to a suitable length, to incinerate the resin coating in a furnace and to recycle the remaining steel pipes. This method is also easy to put into practice, but if the coating material is vinyl chloride, the incineration process produces noxious chlorine gas that causes air or other environmental pollution and badly damages the furnace walls. Further, the steel pipes that are heated undergo composition changes and produce more rust that is detrimental for the recycling process.

Another method used consists of separating the coating resin and steel pipe from waste resin-coated steel pipe pieces and recycling such materials. This method employs a superhigh-pressure water jet of about 200MPa(200N/mm$^2$) to separate the resin coating from the steel pipe. If, however, the resin pieces separated from the steel pipes and containing significant amounts of moisture are used directly for recycling, products produced therefrom are likely to develop mold. First, patterns of silver color appear on the surface of the product and badly impair the outward appearance. Second, the product does not attain a certain degree of inner strength due to the presence of moisture between the resin pieces constituting the product. The simplest and most direct method to solve this problem is to dry the resin pieces, which, however, involves a large investment for the drying equipment and a high energy cost.

SUMMARY OF THE INVENTION

The method, according to the invention, of separating coating resin and steel pipe from resin-coated steel pipe is characterized in that the resin-coated pipe that is made by applying an adhesive on the outer surface of a steel pipe and gluing resin coating thereon is heated by high-frequency induction heating to a temperature no lower than the temperature required to melt the coating resin and the coating resin is scraped away while the inner layer of the coating has melted and the outer layer is softened.

In the invention described above, the coating resin is scraped off of the steel pipe into chips of an appropriate size or into a series of long strips suitable for a further recycling process.

More particularly, this invention is characterized in that a resin-coated steel pipe is passed within or near a high-frequency induction coil by feed rolls and take-up rolls, that the steel pipe is heated through high-frequency induction to a temperature no lower than the temperature required to melt the resin coating and in that the resin is scraped off into chips of a predetermined size by separating rolls rotated in the same direction as the feeding direction of the resin-coated steel pipe, said separating rolls being located at a position in relation to the resin-coated steel pipe after said pipe has passed said high-frequency induction coil and while the inner layer of the resin of said pipe remains melted and the outer layer thereof remains softened. Said separating coils are provided with a plurality of separating blades which are formed to fit to the section of the resin-coated steel pipe and are arranged with a pitch corresponding to the size of chips into which the resin is scraped.

Further, the invention is also characterized in that the resin is scraped off into a series of long strips by separating rolls rotated in the direction opposite to the feeding direction of the resin-coated steel pipe, said separating rolls being located at a position in relation to the resin-coated steel pipe after said pipe has passed said high-frequency induction coil and while the inner layer of the resin of said pipe remains melted and the outer layer thereof remains softened.

Still further, the invention is also characterized in that the resin is scraped off into a series of long strips by separating blades fixed at a position in relation to the resin-coated steel pipe after said pipe has passed said high-frequency induction coil and while the inner layer of the resin of said pipe remains melted and the outer layer thereof remains softened.

According to the principle of high-frequency induction heating adopted in the invention, eddy-currents are generated on the surface of the ferromagnetic steel pipe due to the skin effect and the surface of the steel pipe is heated rapidly by Joule's heat. The thermo-plastic coating resin adhered to the steel surface is heated first at the inner layer and the heat is transferred gradually toward the outer layer. In due time, the inner layer of the thermo-plastic coating resin begins to melt as the temperature reaches the critical level (the melting temperature of ABS resin is, for example, 160°–200° degrees Centigrade) and the resin coating loses adhesion. At this moment, however, the outer layer of the coating resin does not exceed the temperature range of 80°–130° degrees Centigrade and is still in a solid state, though slightly softened. If the coating resin is scraped in this condition from the surface of the steel pipe with a blade, it can be peeled off efficiently and completely, like the bark of a tree. By devising the shape, construction, direction of rotation and the feeding speed of the blades (the separating rolls or the scraping blades), the coating resin can be scraped off into chips or into a series of long strips, which are easy to collect and utilize.

Since the resin recovered by the method according to the invention described above contains no foreign substances, such as moisture, no secondary preprocessing, such as a drying process for dehydration, is needed, which means that the investment in equipment and, hence, the total cost of recycling can by reduced.

The composition of the resin and steel pipe recovered separately is not damaged or destroyed and the materials can by used directly as useful resources for recycling, contributing to the conservation of resources.

According to the invention, the coating resin is scraped off as the inner layer adhering to the surface of the steel pipe is melted and the outer layer is softened, a complete and efficient scraping is effected without a significant investment of energy. Further, since the resin coating is scraped off into chips or a series of long strips, bagging and other handling, and maintenance and storage are all convenient. Moreover, since the long strips of collected resin coating are formed into chips in the secondary processing, temperature control in melting for recycling is easy and homogeneity of the material is maintained.

In this manner, steel pipe and coating resin are recovered as useful resources and thereby contribute to reduction of the volume of industrial waste.

DESCRIPTION OF THE PREFERRED EMBODIMENTS

Figure 1:
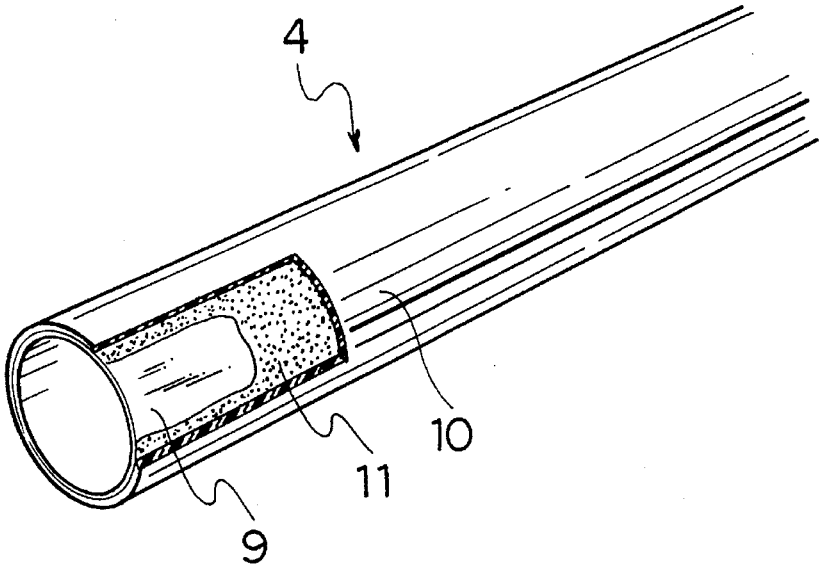
FIG. 1 is a diagonal, partially broken-away view of a resin-coated steel pipe.

The embodiment of the invention shown in the drawings is described as follows.

Figure 3:
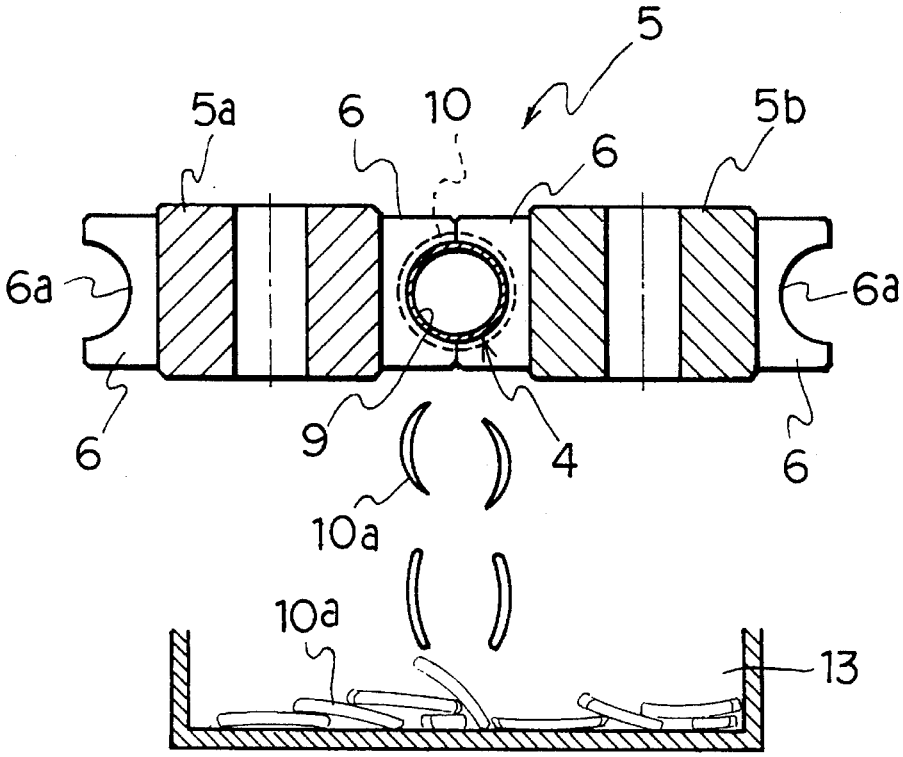
FIG. 3 is an enlarged section of the separating rolls of FIG. 2 taken in the direction of A—A arrows.
Figure 2:
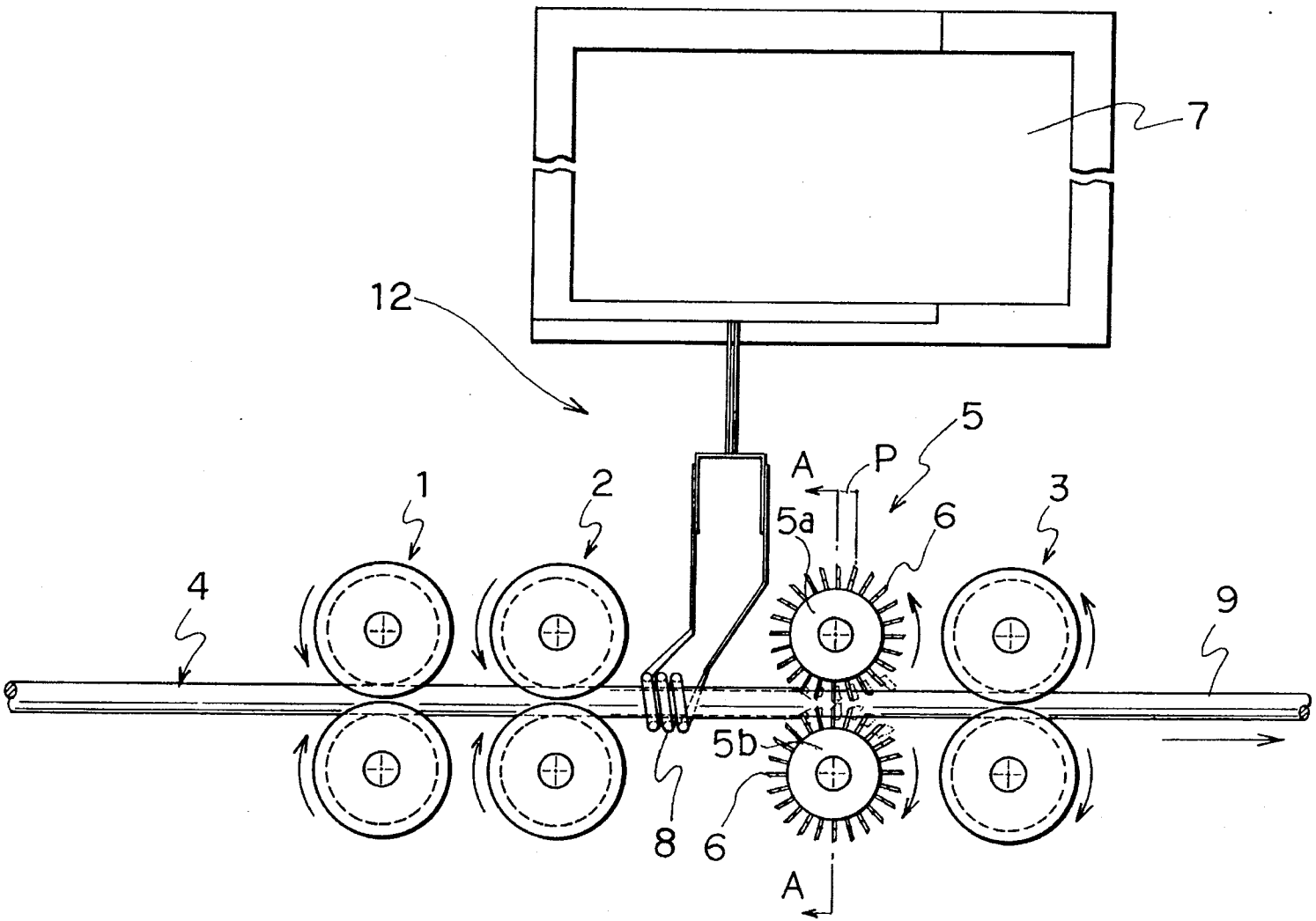
FIG. 2 is a simplified plan view of the main part of the equipment for separating and recovering the coating resin and steel pipe from resin-coated steel pipe.

FIG. 2 shows, in a simplified way, equipment that implements the separating and recovering method according to the invention. Waste resin-coated steel pipe 4 is fed from left to right in FIG. 2, through a high-frequency induction coil 8 by feed rolls 1, 2 and take-up rolls 3. Said high-frequency induction coil 8 is connected to high-frequency heating equipment 12 including a high-frequency power source 7, and heats the steel pipe 9 of the resin-coated pipe 4 that goes through (or passes in the neighborhood of) said coil by the action of high-frequency induction. Separating rolls 5 are provided at a position beyond but near said coil 8 in the advancing direction of the resin-coated steel pipe. As the inner layer of the coating resin 10 melts and loses adhesion with the steel pipe, and the outer layer of the coating resin 10 is scraped from the steel pipe by said separating rolls 5. After passing the separating rolls 5, therefore, only the steel pipe 9 remains, which is taken up by take-up rolls 3. As shown in FIG. 3, the separating rolls 5 consist of a pair of rolls 5*a* and 5*b* which are arranged in symmetric positions opposing each other on the both sides of the resin-coated steel pipe 4. On the outer periphery of each of the rolls 5*a* and 5*b* a plurality of scraping blades 6 are attached radially at a pitch corresponding to the size of the scraped chips 10*a*. Each of the scraping blades 6 has an edge part 6*a* formed as a semi-circle having a radius equal to the outer radius of the resin-coated circular steel pipe 4.

In the equipment shown in FIG. 2, the feed rolls 1, 2 and the take-up rolls 3 are driven in the same direction at a peripheral velocity that corresponds to the feeding speed of the resin-coated steel pipe 4 of 5–10 m/min. The separating rolls 5 are driven for rotation in the same direction at a peripheral velocity greater than the feeding velocity of said resin-coated steel pipe 4 by several meters per minutes and scrapes the coating resin 10. The chips 10*a* scraped by the separating rolls 5 are approximately of a uniform size corresponding to the pitch of said scraping blades and fall into a box 13 provided underneath.

Following, results will be described of tests wherein a resin-coated steel pipe 4 of outer diameter of 27.7 mm consisting of a steel pipe having an outer diameter of 25.5 mm and a coating of AAS resin 10 of 1.1 mm thickness adhered to the surface of said steel pipe 9 with a thermoplastic adhesive 11 (adhesive polyolefin resin) is processed by the equipment shown in FIG. 2 for separation of the resin coating with the high-frequency power source 7 being 10 KV voltage and 3A current and the rolls 1, 2 and the separating rolls 5 being driven at various peripheral velocities.

In the first test, the coating resin 10 was separated and recovered with the feeding velocity of the rolls 1, 2 and the peripheral speed of the separating roll 5 being set at 5 m/min and 10m/min respectively. The result of this test was that the recovered resin chips were melted and resolved and could not be used for recycling. This seems to have been caused by the fact that the resin-coated steel pipe 4 was fed at the velocity that was too low compared to the power of the high-frequency power source and the melting and resolving process had advanced too much by the time the pipe 4 reached the separating roll 5 after passing the high-frequency induction coil 8.

In the second test, the coating resin was separated and recovered with the rolls 1, 2 being driven at the peripheral velocity of 8.6 m/min and the separating rolls 5 at the peripheral velocity of 27 m/min. The result was that the inner layer of the coating resin was completely melted but not resolved and the outer layer was in a softened condition. However, the resin separated from the steel pipe stuck to the separating blades of the separating rolls 6*a*, and it hindered the smooth work of separation and collection. This was believed to have been due to an excessive speed of the peripheral velocity of the separating rolls.

In the third test, the peripheral velocities of the feed rolls and the separating rolls were set at 8.6 m/min and 10.3 m/min respectively. This achieved optimum results: the inner layer of the coating resin was completely melted but not resolved and the outer layer was in a softened condition, while the resin separated from the steel pipe did not stick to the separating blades of the separating rolls and were collected as chips of a uniform size. The results can be explained as follows: the coating resin is successfully scraped off by the scraping blades due to the lowered shearing speed of the softened outer layer and to the reduced peripheral velocity of the separating roll, which prevented the coating resin from sticking to the blades.

Figure 4:
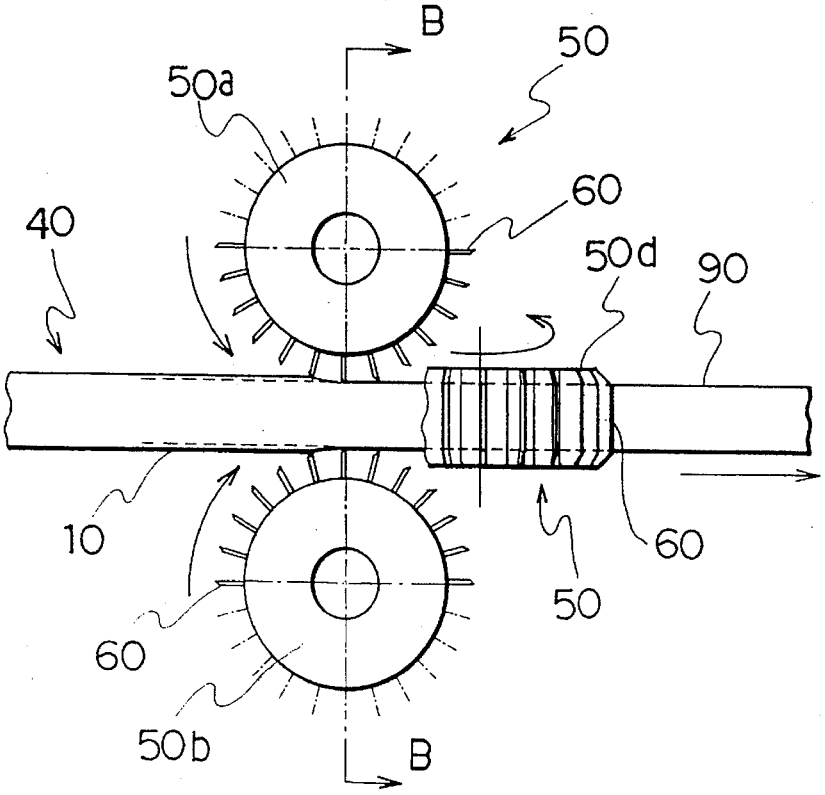
FIG. 4 is a front view of separating rolls which are employed for resin-coated steel pipe having square sections.
Figure 5:
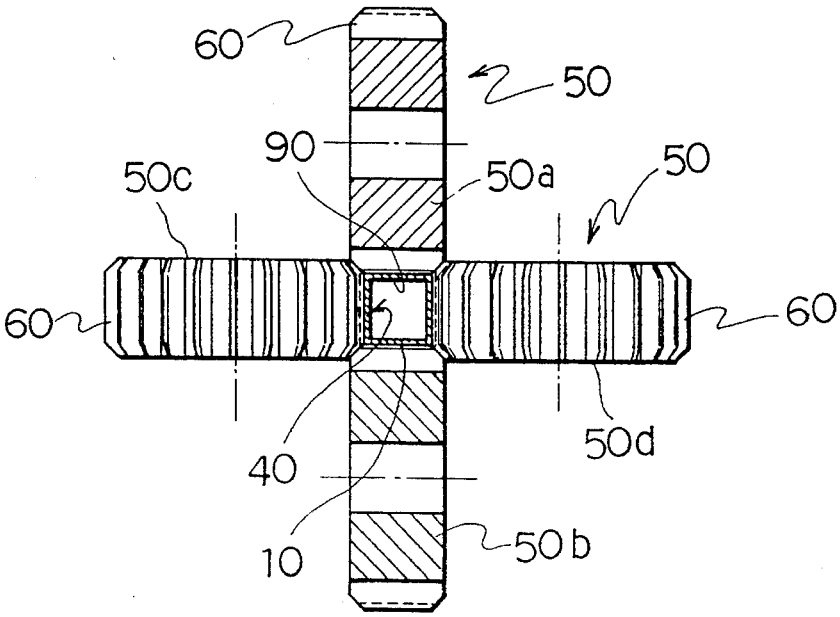
FIG. 5 is a section taken in the direction of B—B arrows of FIG. 4.

FIG. 4 and 5 show the structure for separating rolls 50 for a resin-coated steel pipe having a square section (the structure will be similar for a pipe of rectangular section). The means to pass the resin-coated steel pipe 40 through a high-frequency induction coil and to move said pipe 40 at a constant velocity by feed rolls and take-up rolls are the same as those in FIG. 2 and hence are not shown in the drawings. In this embodiment, the separating rolls 50 consist of four rolls 50*a*, 50*b*, 50*c* and 50*d* which are faced respectively to the four sides of the square sectioned resin-coated steel pipe 40 and are driven in the same direction as the feeding direction of said pipe, each being provided with scraping blades 60 which are parallel to the corresponding side surface of said pipe and having an effective blade length equal to the width of the side. Both ends of the scraping blades 60 of each roll are given a relieving in order not to cause mutual interference. It will be needless to indicate to those skilled in the art that if the resin-coated steel pipe is of a hexagonal or octagonal section, the separating rolls can be constructed as a pair of rolls similar to those shown in FIG. 5.

Figure 6:
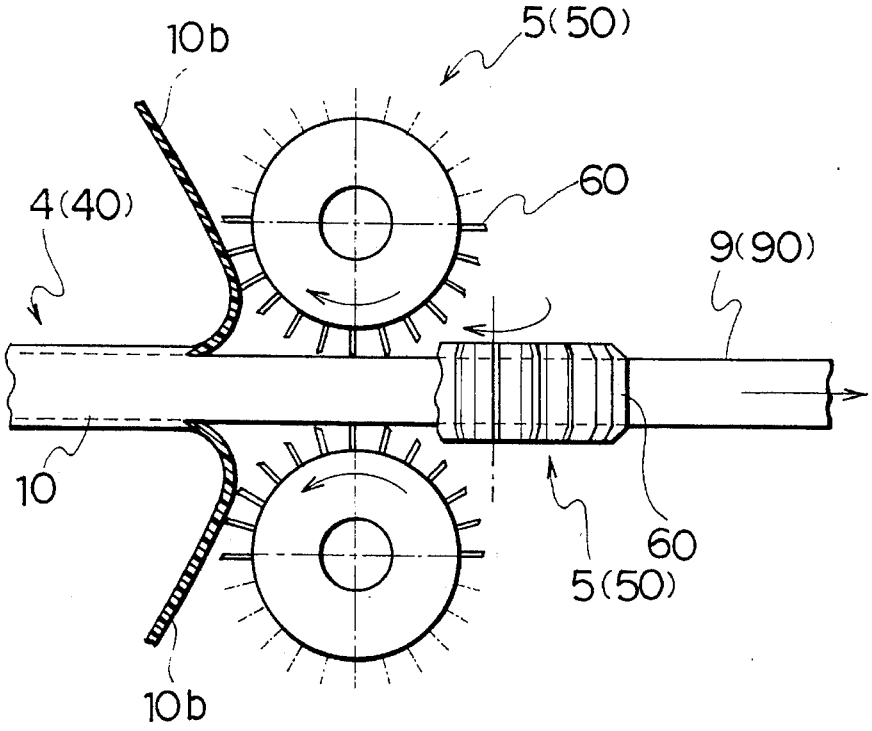
FIG. 6 is a front view of the separating rolls which scrape coating resin into long strips.

FIG. 6, 7 show a means different from those described above by which coating resin is scraped off into a series of long strips.

In FIG. 6, the separating rolls 5(or 50) are arranged in the same manner relative to the resin-coated steel pipe 4(or 40). The scraping blades thereof are formed, however, with an edge 60 on the opposite side, and are rotated in the direction opposite to the direction of the pipe feeding. Owing to this construction, this equipment scrapes the coating resin 10 by the separating rolls 5 at the melted part from the steel pipe 9(or 90) into a series of long strips. If the coating resin 10 is given a cutting process (along cutting lines 16) by means of a cutter or laser beams in a step prior to the resin-coated steel pipe passing the separating rolls, the separating process will be more efficient and easy.

Figure 7:
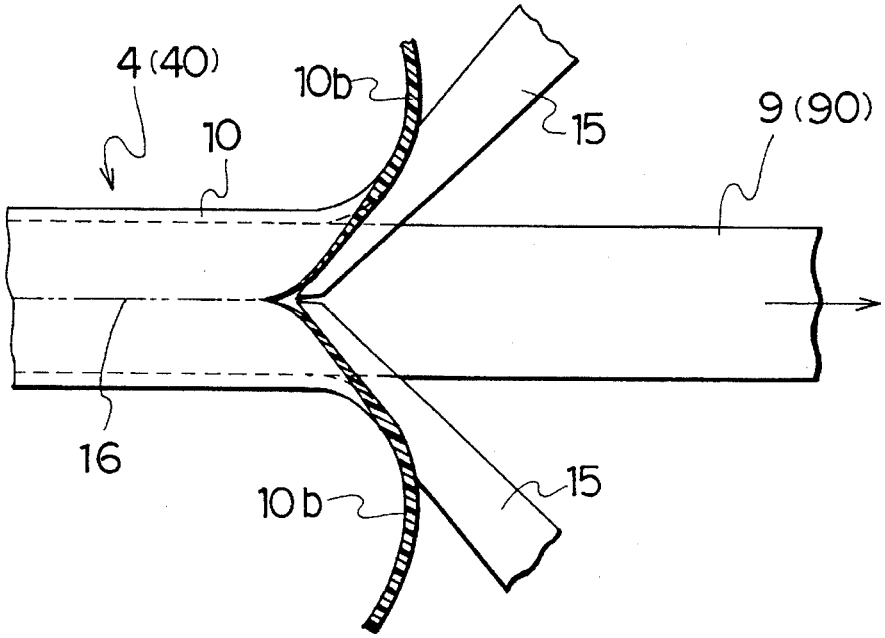
FIG. 7 is a front view of fixed scraping blades which scrape off coating resin into long strips.

FIG. 7 shows a means to scrape off the coating resin 10 into a series of long strips using, instead of the separating rolls described above, scraping blades 15 fixed with a cutting angle directed against the feeding movement of the resin-coated steel pipe 4. The number of the scraping blades is preferably two for resin-coated steel pipes of circular cross section, as in the embodiments described above, but more may be employed. For resin-coated steel pipes of square or rectangular cross section, the number of the blades 15 is preferably four, but more may be employed. By employing this means, the equipment is simplified and hence the cost for separation and recovery can be reduced. Further, if flanges (not shown) made of a resin are fixed on the outer surface of the coating resin, then, through the prior cutting process mentioned above, the scraping of the coating resin and cutting and scraping of the resin flanges can be accomplished simultaneously.

The coating resin 10 scraped off into a series of long strips is further processed by a chipler into chips convenient for recycling. This invention is not to be construed as limited to the particular forms disclosed herein since these are to be regarded as illustrative rather than restrictive.

We claim:

1. A method of removing thermoplastic coating resin from resin-coated steel pipe, comprising the steps of:

(a) heating the steel pipe by high-frequency induction heating to at least melting temperature of the coating resin, whereby an inner layer of the coating resin is melted and an outer layer of the coating resin is softened; and (b) scraping the coating resin off the steel pipe in form of chips or strips while the inner layer of the coating resin is in a melted condition and the outer layer is in a softened condition.

2. A method according to claim 1, wherein step (a) comprises passing the steel pipe in a feed direction through or near a high-frequency induction coil, and step (b) comprises employing at least one scraping tool that is positioned in proximity to said high-frequency induction coil such that when the coating reaches the scraping tool, the coating resin is in form of a melted inner layer and a softened outer layer.

3. A method according to claim 1, wherein step (a) comprises passing the steel pipe in a feed direction through or near a high-frequency induction coil, and step (b) comprises employing at least one scraping roll that is positioned in proximity to said high-frequency induction coil such that when the coating reaches the scraping roll, the coating resin is in form of a melted inner layer and a softened outer layer, and driving the scraping roll in the feed direction.

4. A method according to claim 3, wherein said scraping roll is provided with a plurality of scraping blades that are formed to fit to cross-section of the resin-coated steel pipe and the coating resin is scraped off the steel pipe in form of chips of uniform size corresponding to pitch of the scraping blades.

5. A method according to claim 1, wherein step (a) comprises passing the steel pipe in a feed direction through or near a high-frequency induction coil, and step (b) comprises employing at least one scraping roll that is positioned in proximity to said high-frequency induction coil such that when the coating reaches the scraping roll, the coating resin is in form of a melted inner layer and a softened outer layer, and driving the scraping roll in direction opposite the feed direction.

6. A method according to claim 5, comprising cutting the coating resin prior to employing the scraping roll.

7. A method according to claim 1, wherein step (a) comprises passing the steel pipe in a feed direction through or near a high-frequency induction coil, and step (b) comprises employing at least one scraping blade that is positioned in proximity to said high-frequency induction coil such that when the coating reaches the scraping blade, the coating resin is in form of a melted inner layer and a softened outer layer.

8. A method according to claim 1, wherein the thermoplastic resin is adhered to the steel pipe by an adhesive.

9. A method according to claim 8, wherein step (a) comprises employing feed rolls and take-up rolls to pass the steel pipe in a feed direction through or near a high-frequency induction coil, and step (b) comprises employing scraping rolls that are positioned in proximity to said high-frequency induction coil such that when the coating reaches the scraping rolls, the coating resin is in form of a melted inner layer and a softened outer layer, and driving the scraping rolls in the feed direction.

10. A method according to claim 9, wherein said scraping rolls are provided with a plurality of scraping blades that are formed to fit to cross-section of the resin-coated steel pipe and the coating resin is scraped off the steel pipe in form of chips of uniform size corresponding to pitch of the scraping blades.

11. A method according to claim 8, wherein step (a) comprises employing feed rolls and take-up rolls to pass the steel pipe in a feed direction through or near a high-frequency induction coil, and step (b) comprises employing scraping rolls that are positioned in proximity to said high-frequency induction coil such that when the coating reaches the scraping rolls, the coating resin is in form of a melted inner layer and a softened outer layer, and driving the scraping rolls in direction opposite the feed direction.

12. A method according to claim 11, comprising cutting the coating resin prior to employing the scraping rolls.

13. A method according to claim 8, wherein step (a) comprises employing feed rolls and take-up rolls to pass the steel pipe in a feed direction through or near a high-frequency induction coil, and step (b) comprises employing scraping blades that are positioned in proximity to said high-frequency induction coil such that when the coating reaches the scraping blades, the coating resin is in form of a melted inner layer and a softened outer layer.

14. A method according to claim 1, wherein the thermoplastic resin is acrylonitrile acryl styrene resin or acrylonitrile butadiene styrene resin.

15. A method according to claim 1, comprising recovering the steel pipe for recycling.

16. A method according to claim 1, comprising recovering the chips or strips of coating resin for recycling.

* * * * *